US006356728B1

(12) United States Patent
Watanabe

(10) Patent No.: US 6,356,728 B1
(45) Date of Patent: Mar. 12, 2002

(54) DEVICE AND METHOD FOR CAPTURING LIQUID

(75) Inventor: Toshimi Watanabe, Yamagata (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/711,137

(22) Filed: Nov. 14, 2000

(30) Foreign Application Priority Data

Nov. 15, 1999 (JP) ..... 11-324178

(51) Int. Cl.[7] ..... G03G 15/10
(52) U.S. Cl. ..... 399/250; 399/251; 430/125
(58) Field of Search ..... 399/249, 250, 399/251, 237, 343, 348; 15/256.5, 256.51; 430/125

(56) References Cited

U.S. PATENT DOCUMENTS

| | | | | |
|---|---|---|---|---|
| 5,678,134 A | * | 10/1997 | Miki et al. | 399/71 |
| 5,708,938 A | | 1/1998 | Takeuchi et al. | 399/250 |
| 5,841,456 A | * | 11/1998 | Takei et al. | 399/249 X |
| 5,905,929 A | | 5/1999 | Cho et al. | 399/251 |
| 5,940,666 A | | 8/1999 | Han | 399/249 |
| 6,141,518 A | | 10/2000 | Shin et al. | 399/250 |
| 6,219,512 B1 | * | 4/2001 | Saitoh | 399/249 |

FOREIGN PATENT DOCUMENTS

| | | |
|---|---|---|
| JP | 8-166722 | 6/1996 |
| JP | 2930582 B2 | 5/1999 |
| JP | 11-174769 | 7/1999 |
| JP | 11-184344 | 7/1999 |

* cited by examiner

*Primary Examiner*—Sophia S. Chen
(74) *Attorney, Agent, or Firm*—Foley & Lardner

(57) ABSTRACT

A capture device which captures developer, after used for developing image, from a wet electronic developing device includes a drying belt, a nip roller, a regeneration roller, and a cleaning roller. An absorption layer absorbing solvent is arranged over the outer circumference of the drying belt. The surface of the absorption layer contacts the surface of an organic photo-conductor belt in a predetermined adjacent area. The absorption layer rotates in an opposite direction of the rotational direction of the organic photo-conductor belt, thereby to absorb the solvent and some toner which are included in the developer. An electrostatic latent image is formed on the organic photo-conductor belt and developed using the developer. The nip roller rotates and supports an adjacent section of the drying belt which is adjacent to the organic photo-conductor belt, from the inside of the drying belt. The regeneration roller rotates and supports the drying belt, and includes a first heat source so as to dry the absorption layer with the heat generated by the first heat source. The cleaning roller includes a second heat source, makes the toner absorbed by the absorption layer melt with the heat generated by the second heat source, and removes the toner therefrom so as to dry the absorption layer.

22 Claims, 5 Drawing Sheets

DEVICE AND METHOD FOR CAPTURING LIQUID

BACKGROUND OF THE INVENTION

1. Field of the Invention

The present invention relates to a device and method for capturing liquid, and, more particularly, to a device and method for capturing solvent included in developer.

2. Description of the Related Art

A wet developing process is one developing process to be employed in an electro-photography recording apparatus, such as a copy machine, laser printer, etc. The developer for use in this developing process is a mixture of toner and solvent, and is stored or handled with ease as compared to a case where only the toner is used as the developer.

After developing photographic any image, the solvent (liquid) included in the developer needs to be captured.

A capture device for capturing the solvent included in the developer is disclosed in Unexamined Japanese Patent Application KOKAI Publication Nos. H8-166722, H11-174769, H11-184344 and in Japanese Patent Publication No. 2930582.

In the capture device disclosed in Unexamined Japanese Patent Application KOKAI Publication No. H8-166722, an electrostatic latent image is formed on an organic photo-conductor drum, and the electrostatic latent image is developed by a wet developing device. Further, in the capture device, the toner image is transferred onto a printing paper so as to make a color copy of the toner image.

However, th is capture device does not disclose the structure for capturing the developer from the organic photo-conductor drum. Hence, the solvent used for developing images remains on the organic photo-conductor drum, and is transferred onto the printing paper, causing deterioration of the image quality.

Unexamined Japanese Patent Application KOKAI Publication Nos. H11-174769, H11-184344 and Japanese Patent Publication No. 2930582 disclose a capture device for capturing the solvent included in the developer and remaining on an organic photo-conductor belt.

In the capture device disclosed in Unexamined Japanese Patent Application KOKAI Publication Nos. H11-174769, H11-184344, the solvent remaining on the organic photo-conductor belt is absorbed by a drying roller and vaporized by a heating roller. However, in this structure, it is difficult to control the temperature of the drying roller. For example, if the temperature of the drying roller is set high, the toner is likely to melt so as to be adhered onto the drying roller. On the contrary, if the temperature of the drying roller is set low, the drying roller does not get dried itself, it can not absorb the solvent. Furthermore, the drying roller captures, together with the solvent, the toner which has not formed up the toner image. However, it is difficult to remove the toner absorbed by the drying roller therefrom.

A drying roller included in the capture device disclosed in Japanese Patent Publication No. 2930582 includes a hollow connected to a capture and has a plurality of holes piercing the hollow. An absorption member for absorbing the solvent is mounted on the outer surface of the drying roller. The solvent absorbed by the absorption member reaches the hollow through the plurality of holes, and is captured by a capture. The solvent remaining in the absorption member is heated up by a heating roller so as to be vaporized.

However, if the plurality of holes are simply formed, the solvent absorbed by the absorption member does not flow into the hollow. Even in this structure, it is difficult to control the temperature of the drying roller. For example, if the temperature of the drying roller is set high, the toner is likely to melt and adhered onto the drying roller. On the contrary, if the temperature of the drying roller is set low, the drying roller does not get dried, so that it can not absorb the solvent. Further, the drying roller captures, together with the solvent, the toner which has not formed up the toner image. However, it is difficult to remove the toner absorbed by the drying roller therefrom.

SUMMARY OF THE INVENTION

The present invention has been made in consideration of the above. It is accordingly an object of the present invention to provide a device and method for capturing liquid, particularly for absorbing the solvent with ease while avoiding absorbing any solid organism, when to absorb the solvent from ink.

Another object thereof is to provide a device and method for capturing liquid, which can remove any solid organism captured when absorbing the solvent from ink, and vaporize the absorbed solvent with ease.

Still another object thereof is to provide a device and method for capturing liquid, which can easily absorb solvent from ink and vaporize the absorbed solvent with ease.

In order to achieve the above objects, according to the first aspect of the present invention, there is provided a liquid capture device, which captures developer, having used for developing an electrostatic latent image formed on a rotatable organic photo-conductor belt, and being formed of solvent and the toner, the device comprising:

a drying belt over outer circumference of which an absorption layer absorbing the solvent is arranged, and a surface of which is adjacent to a surface of the organic photo-conductor belt in a predetermined adjacent area, and also which rotates in an opposite direction of a rotational direction of the organic photo-conductor belt so as to absorb the solvent and a part of the toner;

a nip roller of the drying belt which rotates and supports an adjacent section, which is adjacent to the organic photo-conductor belt, from an inside of the drying belt;

a regeneration roller which rotates and supports the drying belt, includes a first heat source, and dries the absorption layer by heat generated by the first heat source; and a cleaning roller which includes a second heat source, causes the toner absorbed by the absorption layer with heat generated by the second heat source so as to remove the toner therefrom, and dries the absorption layer.

In order to achieve the above objects, according to the second aspect of the present invention, there is provided a method for capturing developer from a rotatable organic photo-conductor belt on which an electrostatic latent image developed using the developer formed of solvent and the toner is formed, the method comprising:

supporting a drying belt, over outer circumference of which an absorption layer absorbing liquid is arranged, with a nip roller and a regeneration roller, and arranging a section, which is supported by the nip roller, adjacent to the organic photo-conductor belt;

rotating the drying belt in a direction opposite to a rotational direction of the organic photo-conductor belt, thereby the developer on the organic photo-conductor belt is absorbed by the absorption layer;

setting a cleaning roller, which is heated up, to contact the absorption layer having absorbed the developer, thereby to remove the toner included in the absorption layer and to vaporize the solve included in the absorption layer; and setting the regeneration roller, which is heated up, to contact the absorption layer from which the toner is removed by the cleaning roller, thereby to vaporize the solvent included in the absorption layer.

BRIEF DESCRIPTION OF THE DRAWINGS

These objects and other objects and advantages of the present invention will become more apparent upon reading of the following detailed description and the accompanying drawings in which.

DETAILED DESCRIPTION OF THE PREFERRED EMBODIMENT

A liquid capture device according to an embodiment of the present invention will specifically be explained with reference to the accompanying drawings.

Figure 1:
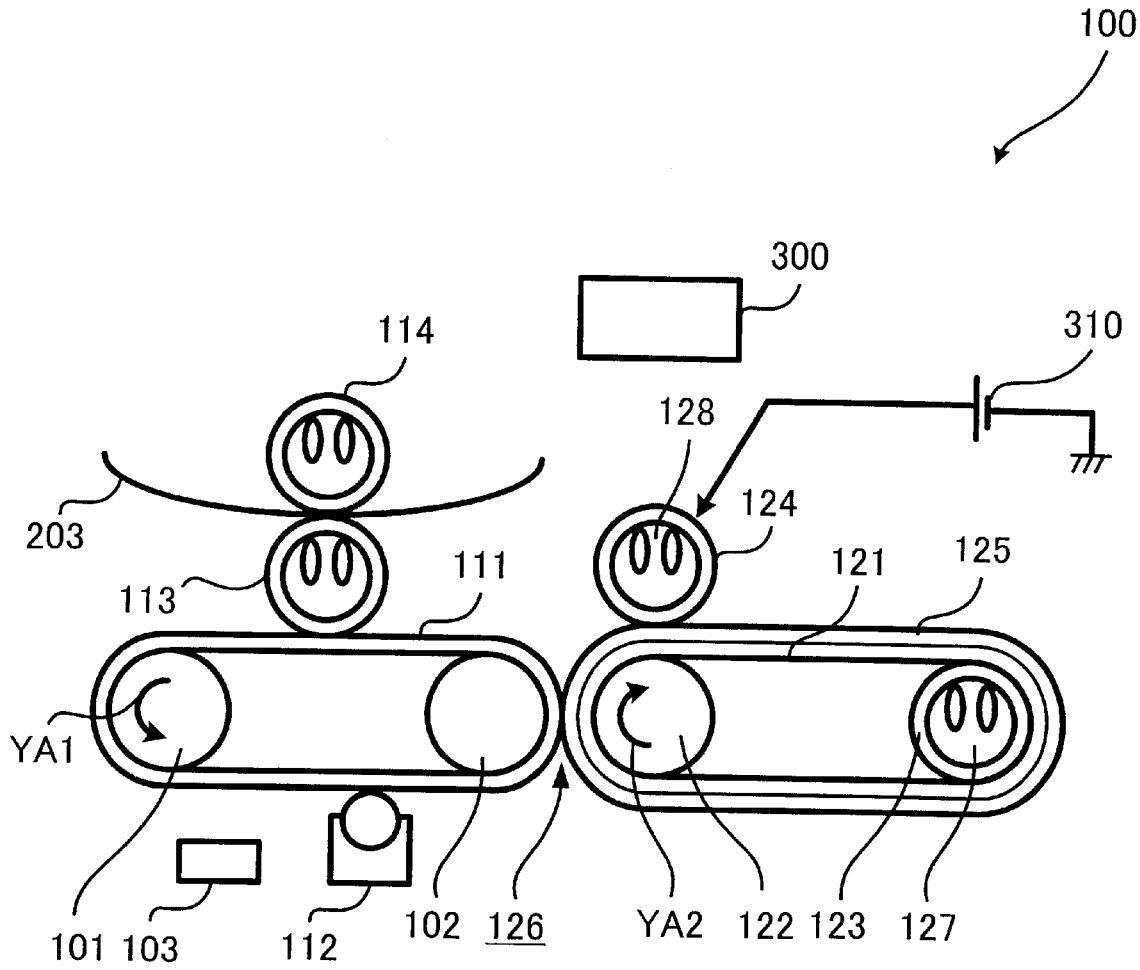
FIG. 1 is a diagram showing the structure of a liquid capture device according to an embodiment of the present invention.

FIG. 1 is a structural diagram showing the structure of the liquid capture device according to this embodiment.

The liquid capture device 100 shown in FIG. 1 comprises an organic photo-conductor belt 111, a developing device 112, a transfer roller 113, a fuser roller 114, a drying belt 121, a nip roller 122, a regeneration roller 123, a cleaning roller 124, a capture 300, and a power source 310.

The organic photo-conductor belt 111 is driven by a driving roller 102, and is a seamless belt which rotates while supported by a tension roller 101. An electrostatic latent image is formed on the surface of the organic photo-conductor belt 111 by a laser 103. The driving roller 102 rotates in a counterclockwise direction, as shown with an arrow YA1.

The developing device 112 applies the developer onto the surface of the organic photo-conductor belt 111. The developer is formed of the fine particle toner and the solvent. The toner included in the developer is attracted by an electric charge on the organic photo-conductor belt 111, and travels in the solvent so as to create a toner image corresponding to the electrostatic latent image which is formed by the electric charge. In this specification, such a function is referred to as "developing".

The transfer roller 113 rotates while being in contact with the organic photo-conductor belt 111, receives the toner included in the developer on the organic photo-conductor belt 111, and transfers the received toner on a printing paper 203. In other words, the transfer roller 113 rotates in synchronization with the organic photo-conductor belt 111, transfers the toner image on the organic photo-conductor belt 111 onto the surface of the transfer roller 113, and transfers the toner image onto the printing paper 203.

The fuser roller 114 rotates while being in contact with the transfer roller 113 between both of which the printing paper 203 is sandwiched, so that the toner transferred onto the transfer roller 113 melts. The toner is transferred from the transfer roller 113 onto the printing paper 203, thereby to create a visible image with the toner.

The drying belt 121 is another seamless belt, and is supported by the rotatable nip roller 122 and the regeneration roller 123. The drying belt 121 rotates in a direction opposite to the rotational direction of the organic photo-conductor belt 111, as shown with an arrow YA2.

The absorption layer 125 is arranged over the entire surface of the drying belt 121. The absorption layer 125 is in contact with the organic photo-conductor belt 111 on the side adjacent to the nip roller 122.

The drying nip 126 is a nip having a function for drying the transfer roller 113, and is formed between the organic photo-conductor belt 111 and the drying belt 121. The drying nip 126 causes the solvent included in the developer on the organic photo-conductor belt 111 to be absorbed by the absorption layer 125, thereby the toner remains on the organic photo-conductor belt 111.

The regeneration roller 123 includes a lamp 127 including a halogen lamp, etc.

The regeneration roller 123 is so prepared that the solvent absorbed by the absorption layer 125 over the drying belt 121 is evaporated by the heat of the lamp 127.

The surface of the cleaning roller 124 is in contact with the surface of the drying belt 121 in a position downstream with respect to the drying nip 126 as regards the rotational direction of the drying belt 121.

The cleaning roller 124 includes a lamp 128, and is so prepared that the toner absorbed by the absorption layer 125 melts by the heat of the lamp 128. The cleaning roller 124 then captures the melted toner, and makes the solvent evaporated. The lamp 128 includes a halogen lamp, etc.

The capture 300, immediately or after having liquefied the solvent, captures the solvent which has turned into the form of vapor.

The power source 310 applies, to the cleaning roller 124, a voltage of a polarity which is opposite to the polarity of a voltage applied to the toner on the organic photo-conductor belt 111.

Figure 2:
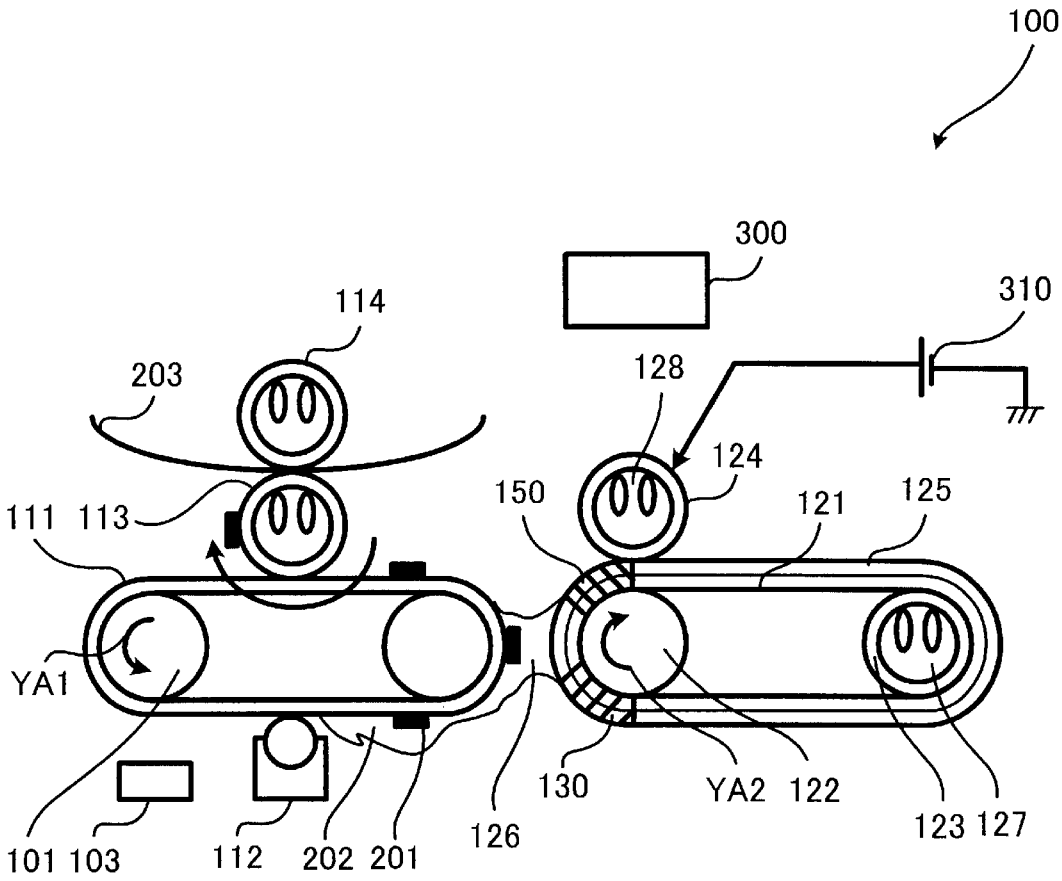
FIG. 2 is a diagram for explaining operations of the liquid capture device shown in FIG. 1.

Operations in which the liquid capture device 100 captures the solvent will now be explained with reference to FIG. 2.

The organic photo-conductor belt 111, rotates in a counterclockwise direction as shown with the arrow YA1, while the drying belt 121 rotates in a clockwise direction as shown with the arrow YA2.

A laser section 103 radiates a laser beam onto the organic photo-conductor belt 111, which is charged with electricity, so as to form an image (an electrostatic latent image) by an effect of static electricity on the organic photo-conductor belt 111.

The developing device 112 applies the developer, which is formed of the toner and solvent 202, onto the surface of the organic photo-conductor belt 111. The toner included in the developer is attracted by static electricity on the organic photo-conductor belt 111, and travels in the solvent so as to be adhered to an electrically-charged section of the organic photo-conductor belt 111. Thus, the toner is so spread as to correspond to the electrostatic latent image, thereby creating a visible image 201 (toner image).

A portion of the organic photo-conductor belt 111, onto which the developer is applied, enters the drying nip 126, along with the rotation of the organic photo-conductor belt 111. The organic photo-conductor belt 111 is scraped again the absorption layer 125 over the drying, belt 121, which rotates in a direction opposite to the rotational direction of the organic photo-conductor belt 111, by the drying nip 126. As a result of this, the solvent 202 on the organic photo-conductor belt 111 is captured by the drying nip 126 and absorbed by the absorption layer 125. At the same time, some toner and impurities are absorbed thereby together with the solvent 202. The toner forming up the toner image is firmly adhered to the surface of the organic photo-conductor belt 111 by the effect of the static electricity, thus should not be absorbed by the absorption layer 125.

After a portion of the drying belt 121, onto which the solve and the toner and the like is adhered, gets past the drying nip 126, the portion contacts the surface of the cleaning roller 124.

Since the cleaning roller 124 is heated up by the lamp 128 arranged therein side, the toner and the like melts on the drying belt 121, and is adhered to and captured by the cleaning roller 124. The toner on the cleaning roller 124 is removed therefrom, after the cleaning roller 124 is cleaned or replaced with a new cleaning roller. Since the voltage of the polarity which is opposite to the polarity of the voltage applied to the toner is applied to the cleaning roller 124 from the power source 310, the toner on the absorption layer 125 is relatively easily adhered to the cleaning roller 124 according to Coulomb's law.

The absorption layer 125 is heated up by the lamp 128 and the lamp 127 which is arranged inside the regeneration roller 123, thus the solvent 202 absorbed by the absorption layer 125 is vaporized. The vaporized solvent 202 is then captured by the capture 300.

The drying belt 121 further rotates, gets past the regeneration roller 123 so as to get cooled down, and reaches the drying nip 126 again.

The toner image 201 remaining on the organic photo-conductor belt 111 is transferred onto the transfer roller 113, and melts by the effect of the fuser roller 114. Further, the toner image 201 is then transferred to the printing paper 203, thereby to form an image.

As explained above, the liquid capture device 100 captures the solvent included in the developer for use in developing an image. The liquid capture device 100 is to satisfy the following several conditions, so that the solvent is absorbed with high efficiency so as to turn into a vapor.

(1) Temperature of Drying Nip

If the temperature of the drying nip 126 is too high, the problem is that the solvent 202 in the drying nip 126 is vaporized, and the toner 201 melts and is absorbed by the absorption layer 125.

In order to overcome this problem, it is preferred that the temperature of the drying nip 126 or an area 130 of the drying belt 121, which is immediately behind the area where the drying nip 126 is formed, is set to a temperature at which the solvent 202 is not vaporized and the toner 201 is not to melt.

(2) Length of Drying Nip

The length of the drying nip 126 is the length of the section of the organic photo-conductor belt 111 and the drying belt 121 being in contact with each other, as illustrated in FIG. 1.

If the length of the drying nip 126 is too short, the solvent can not satisfactorily be absorbed while the organic photo-conductor belt 111 and the drying belt 121 contact each other for short period of time, thus the solvent 202 remains on the organic photo-conductor belt 111. Some solvent 202, which is not captured, stays on the drying nip 126, resulting in that the drying belt 121 slips through the solvent.

On the contrary, if the length of the drying nip 126 is too long, the toner 201 is heated up for quite a time. Thus, the problem is that the toner forming the toner image 201 melts and is absorbed by the absorption layer 125.

Hence, if an appropriate length of the drying nip 126 is not given, a toner image is unsatisfactorily transferred onto the transfer roller 113. In order to overcome this problem, it is preferred that the length of the drying nip 126 is set into a range between 2.0 and 9 mm, or desirably into a range between 3.0 and 7.5 mm.

(3) Outside Diameter of Regeneration Roller

The liquid capture device 100 repeats the absorbing and vaporizing of the solvent 202. Thus, it is desired that the liquid capture device 100 has a function Dr for evaporating the solvent 202 which function is more efficiently performed than a function Ab for absorbing the solvent 202. The relationship between such functions can be found from Formula 1.

$$Ab<Dr \tag{1}$$

where:

$$Ab=Av\times Aw\times A1;$$

$$Dr=Dv\times Dw\times D1;$$

Ab [$mm^2$·mg/sec] denotes an amount of solvent to be absorbed; Dr [$mm^2$·mg/sec] denotes an amount of solvent to be vaporized; Av [mg/sec] denotes the rate solvent is absorbed; Aw [mm] denotes the width of a portion of an absorption layer absorbing the solvent; A1 [mm] denotes the length of a portion of an absorption layer absorbing the solvent; Dv [mg/sec] denotes the rate solvent is vaporized; Dw [mm] denotes the width of a portion of solvent to be dried; and D1 [mm] denotes the length of a portion of solvent to be dried.

A transformation of Formula 1 is:

$$D1>Av\times Aw\times A1/(Dv\times Dw)$$

Hence, the minimum value $D1_{MIN}$ of the length D1 can be obtained from the following equation:

$$D1=Av\times Aw\times A1/(Dv\times Dw)$$

Figure 3:
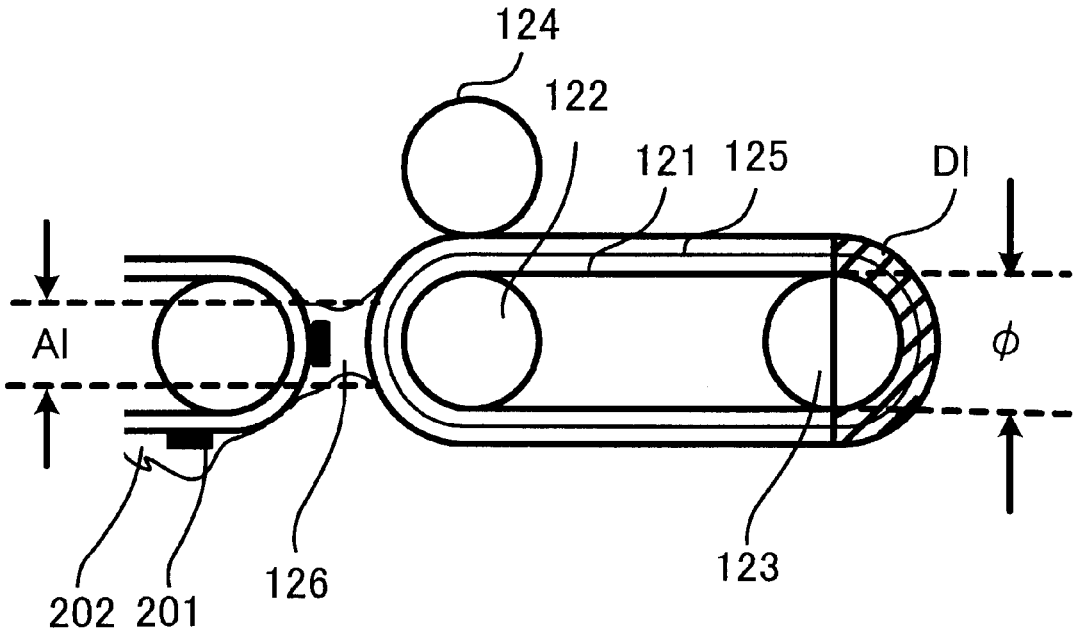
FIG. 3 is a diagram for explaining the conditions for setting an outside diameter of a regeneration roller shown in FIG. 1.

As exemplarily shown in FIG. 3, length $D1_{MIN}$ corresponds to one half of the length of the circumference of the regeneration roller 123. Hence the minimum value $\phi_{MIN}$ of the outside diameter of the regeneration roller 123 can be expressed from the following formula 2:

Note that, as exemplarily shown in FIG. 3, the length A1 can be assumed to be the length of the drying nip 126.

$$\phi_{MIN}=Av\times Aw\times A1/(Dv\times Dw)\times(2/\pi) \tag{2}$$

With reference to the relationship expressed from Formula 1, specific processes for obtaining the outside diameter of the regeneration roller 123 will be described as follows:

In the surroundings (Let it be assumed that the temperature is 80° C.) where the liquid capture device 100 is used, the rate Av at which the solvent 202 is vaporized from the absorption layer 125 with the width of 50 mm in all directions (2500 $mm^2$) can be expressed from the following equation:

$Av=7.54$[mg/sec]

Similarly, the rate Dv at which the absorption layer 125 with the width of 50 mm in all directions (2500 $mm^2$) absorbs the solvent 202 can generally be expressed from the following equation:

$Dv=1.22$[mg/sec]

Hence, the ratio of the absorption rate Av to the evaporation rate Dv can be found from the following equation:

$Av/Dv=6.18$

If the width of the absorption layer 125 is fixed (Aw=Dw), from the expression of inequality Ab<Dr of Formula 1, the relationship between the length A1 and the length D1 can be expressed from Formula.

$$A1\times 6.18<D1 \quad (3)$$

Thus, in the case where the length A1 of the drying nip 126 is set to A1=7.5 [mm], for example, the minimum value $D1_{MIN}$ of the length D1 can be obtained from Formula 4.

$$D1_{MIN}=7.5\times 6.18=46.35[\text{mm}] \quad (4)$$

The length $D1_{MIN}$ corresponds to one half of the length of the circumference of the regeneration roller 123. Hence, the minimum value$\phi_{MIN}$ of the circumference of the regeneration roller 123 is obtained from Formula 5.

$$\phi_{MIN}=D1\times 2/\pi=29.5\ [\text{mm}] \quad (5)$$

Thus, it is preferred that the outside diameter of the regeneration roller 123 is equal to or larger than 29.5 mm, in this example.

The so-far explained description is only one example, and specific values should appropriately be set in accordance with the conditions of the regeneration roller.

(4) Length of Area of Drying Belt Which Is Cooled Down

Figure 4:
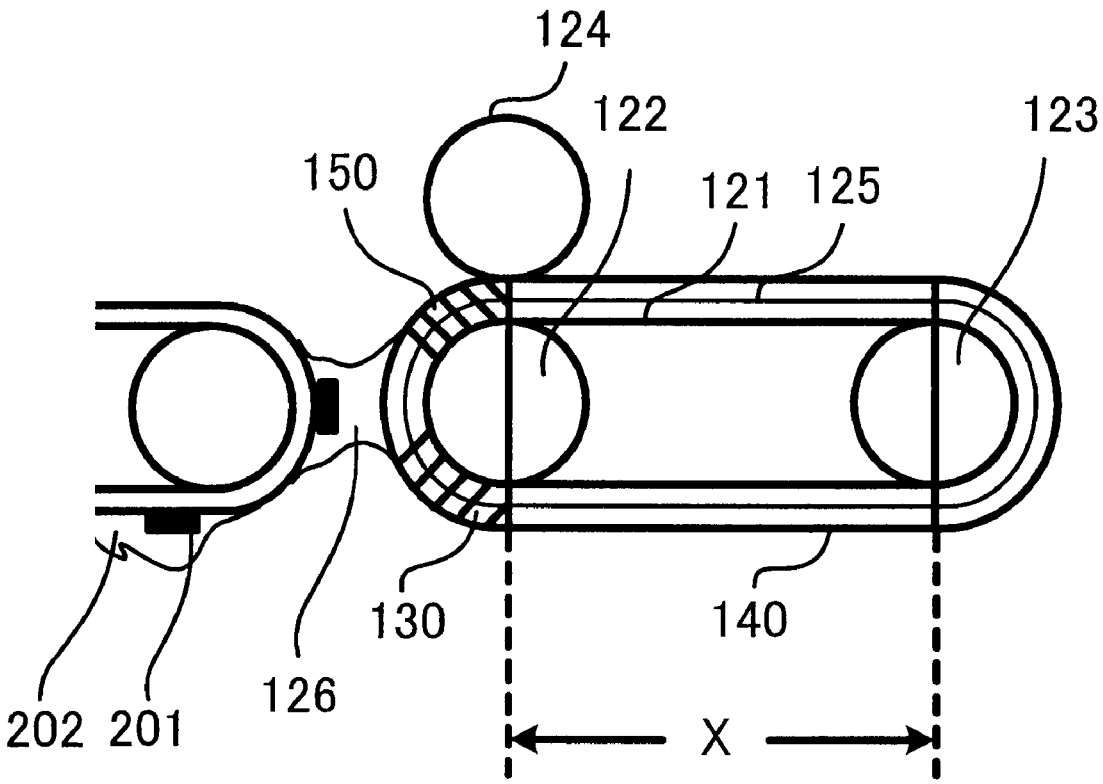
FIG. 4 is a diagram for explaining the conditions for setting the length of a cooled section of a drying belt which is shown in FIG. 1.

As illustrated in FIG. 4, an area 140 of the drying belt 121, which is positioned between the rotational central axes of the nip roller 122 and of the regeneration roller 123 and is on the opposite side of the cleaning roller 124, is cooled down.

Figure 5:
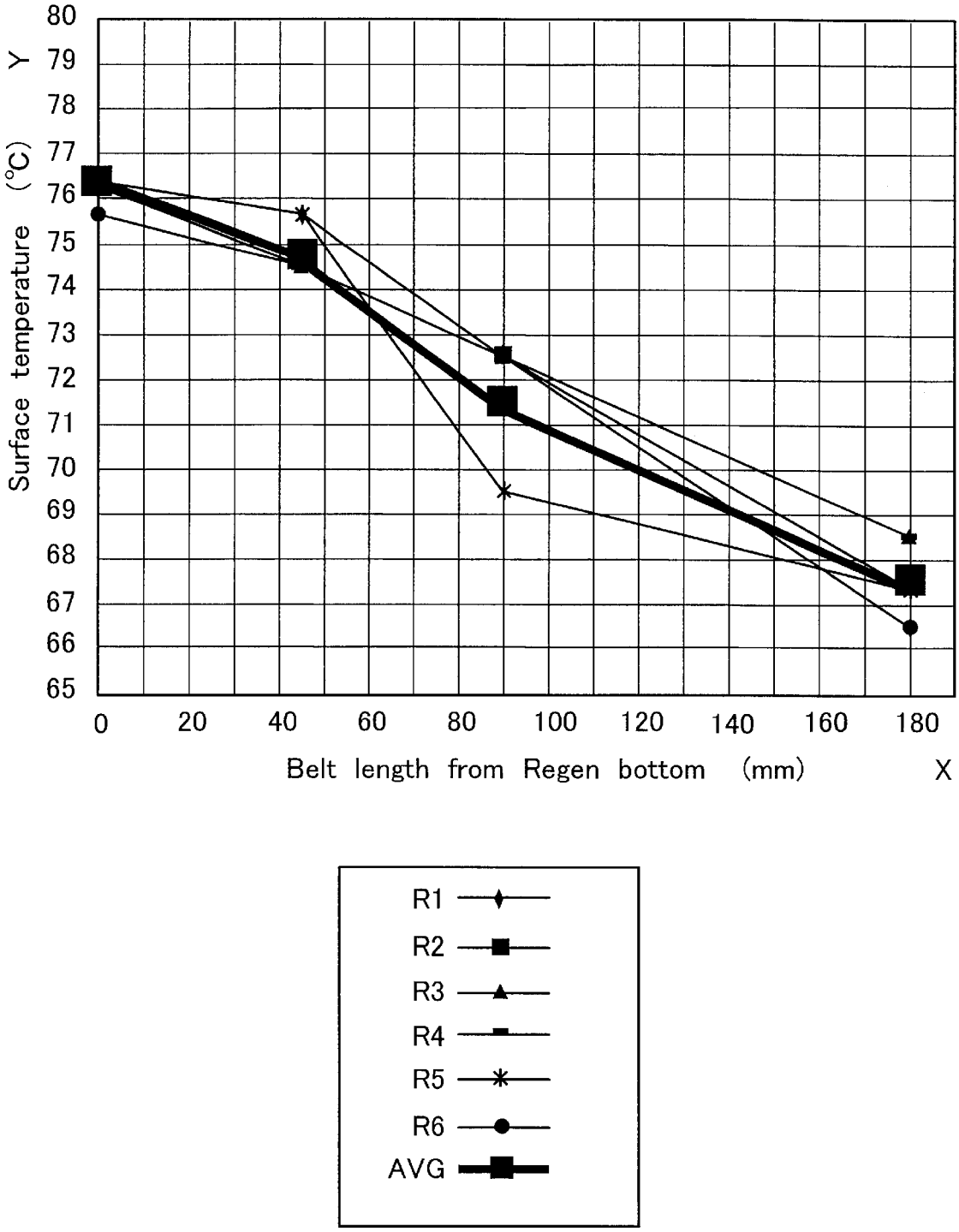
FIG. 5 is a diagram showing the relationship between the lengths of the cooled section of the drying belt and the surface temperature of a cleaning roller shown in FIG. 1.

The length of the cooled area 140 of the drying belt 121 is set based on the graph of FIG. 5. FIG. 5 is a diagram showing the relationship between particular positions X [mm] in the area 140, each showing the distance measured along the horizontal direction of the drying belt 121 with respect to the rotational central axis of the regeneration roller 123, and surface temperatures Y [°C.] of the drying belt 121 in the respective positions X.

In FIG. 5, a curve line AVG shows average values of the results of six tests, R1 to R6. The entire points (X, Y) on the curve line AVG satisfy the following Formula 6.

$$Y=0.0000294X^2-0.0542X+76.6 \quad (6)$$

According to Formula 6, in the case where to set the temperature of the area 130 of the drying belt 121, which is immediately behind the area where the drying nip 126 is formed, equal to or lower than 70 [°C.], the length X of the cooled area 140 of the drying belt 121 needs to be set to equal to or longer than 125 [mm]. In this embodiment, the length X of the cooled area is thus determined, and the temperature of the area 130 is retained to a temperature the solvent is vaporized and the toner is to melt.

(5) Thickness of Absorption Layer

If the absorption layer 125 of the drying belt 121 is too thick, it dramatically absorbs the developer. Thus, the toner is easily absorbed by the absorption layer 125, resulting in deterioration of the toner image 201. In addition, the solvent 202 is hardly vaporized from the absorption layer 125.

On the contrary, if the absorption layer 125 is too thin, it can not sufficiently absorb the developer, and it does not last long.

Therefore, it is desired that the thickness of the absorption layer 125 is in a range between 25 and 80 $\mu$m.

(6) Surface Temperature of Cleaning Roller

If the temperature of the cleaning roller 124 being heated up by the heat of the lamp 128 is too low, it can hardly remove the toner 201 absorbed by the absorption layer 125.

The surface temperature of the cleaning roller 124 is determined on the basis of the temperature of an area 150 of the drying belt 121 which is immediately behind the area in contact with the cleaning roller 124, as shown in FIG. 4.

Note that if the surface temperature of the cleaning roller 124 is too high, the temperature of the drying nip 126 increases, and the problem is that the toner 201 is easily absorbed by the absorption layer 125.

Therefore, it is desired that the surface temperature of the cleaning roller 124 is so set that the temperature of the drying nip 126 is equal to or lower than 79° C., and that the surface temperature of the cleaning roller 124 is higher than the temperature of the area 150 of the drying belt 121 by at least 10° C.

(7) Applying Voltage

The toner 201 and impurities absorbed by the absorption layer 125 are charged with electricity, thus are not likely to be transferred onto the cleaning roller 124.

Therefore, it is desired that the cleaning roller 124 is charged and a current voltage of an opposite polarity, which is opposite to the polarity of the toner, is applied to the surface of the cleaning roller 124 by the power source 310, for example, at any time or when the transferring operation is not carried out by the liquid capture device 100.

As explained above, the liquid capture device of this embodiment can appropriately capture the solvent on the organic photo-conductor belt 111 and the toner, which has not contributed the formation of the toner image.

Various embodiments and changes may be made there onto without departing from the broad spirit and scope of the invention. For example, in the above-described embodiment, the explanations have been made to the device for capturing the developer on the organic photo-conductor belt 111. However, the present invention is not limited to the organic photo-conductor belt, and can be adapted to any other belt, which is charged with electricity and can maintain the electrostatic latent image by the effect of the static electricity.

Furthermore, the explanations have been made to the case where the lamp(s) is employed as a heat source, however, any other heat source can be employed.

The above-described embodiment intended to illustrate the present invention, not to limit the scope of the present invention. The scope of the present invention is shown by the attached claims rather than the embodiment. Various modifications made within the meaning of an equivalent of the claims of the invention and within the claims are to be regarded to be in the scope of the present invention.

This application is based on Japanese Patent Application No. H11-324178 filed on Nov. 15, 1999, and including specification, claims, drawings and summary. The disclosure of the above Japanese Patent Application is incorporated herein by reference in its entirety.

What is claimed is:

1. A liquid capture device, which captures developer that has been used for developing an electrostatic latent image formed on a rotatable organic photo-conductor belt, the developer being formed of solvent and toner, said device comprising:

a drying belt, over an outer circumference of which an absorption layer absorbing the solvent is arranged, and a surface of which is adjacent to a surface of the organic photo-conductor belt in a predetermined adjacent area, and which rotates in an opposite direction of a rotational direction of the organic photo-conductor belt so as to absorb the solvent and a part of the toner;

a nip roller of said drying belt which rotates and supports an adjacent section of said drying belt, which is adjacent to the organic photo-conductor belt, from an inside of said drying belt;

a regeneration roller which rotates and supports said drying belt, includes a first heat source, and dries the absorption layer by heat generated by the first heat source; and a cleaning roller which includes a second heat source, and which removes the toner absorbed by the absorption layer with heat generated by the second heat source, and dries the absorption layer.

2. The liquid capture device according to claim 1, wherein said drying belt is retained to a temperature at which the solvent is not substantially vaporized and the toner does not melt in the adjacent section.

3. The liquid capture device according to claim 2, wherein said drying belt is retained to a temperature equal to or lower than 79° C. in the adjacent section.

4. The liquid capture device according to claim 1, wherein a length of the adjacent section which is adjacent to the organic photo-conductor belt is so set that an arbitrary point of the organic photo-conductor belt is positioned in the adjacent section for a longer time period than a time period the solvent is absorbed by the absorption layer and shorter than a time period the toner completely melts.

5. The liquid capture device according to claim 4, wherein said drying belt approaches the organic photo-conductor belt such that the length of the adjacent section is in a range between 2.0 and 9 mm.

6. The liquid capture device according to claim 1, wherein a diameter of said regeneration roller is so set that an amount of the solvent absorbed by the absorption layer and vaporized is larger than an amount of the solvent absorbed by the absorption layer.

7. The liquid capture device according to claim 1, wherein:

a temperature of said drying belt decreases at a predetermined slope in accordance with a distance from said regeneration roller; and a distance between said nip roller and said regeneration roller is so set that the adjacent section is retained to a temperature at which the toner does not melt.

8. The liquid capture device according to claim 1, wherein a relationship between a position X within a cooled area of said drying belt, which is positioned between said regeneration roller of said drying belt and said nip roller, and a surface temperature Y at the position X, is represented by $$Y=A\cdot X^2-B\cdot X+C$$

where A, B and C each denotes a constant.

9. The liquid capture device according to claim 1, wherein a thickness of the absorption layer is so set to a value that the solvent and the toner not adhered to the organic photo-conductor belt are easily absorbed thereby in the adjacent section of said drying belt, and that the absorption layer is easily dried by said regeneration roller and said cleaning roller.

10. The liquid capture device according to claim 9, wherein the absorption layer is formed in a range between 25 and 80 $\mu$m in thickness.

11. The liquid capture device according to claim 1, wherein a surface temperature of said cleaning roller is set to a temperature higher than a temperature of a section of said drying belt, which is immediately behind a section being in contact with said cleaning roller, so that the toner absorbed by the absorption layer can be removed with ease.

12. The liquid capture device according to claim 11, wherein the surface temperature of said cleaning roller is set to a temperature higher, by at least 10° C., than the temperature of the section of said drying belt, which is immediately behind the section being in contact with said cleaning roller.

13. The liquid capture device according to claim 1, further comprising a power source for applying a voltage, to said cleaning roller, of an opposite polarity which is opposite to a polarity of a voltage applied to the toner.

14. The liquid capture device according to claim 1, wherein said drying belt is in contact with the organic photo-conductor belt in the adjacent section.

15. A method for capturing developer from a rotatable organic photo-conductor belt on which an electrostatic latent image developed using a developer formed of solvent and toner is formed, said method comprising:

supporting a drying belt, over an outer circumference of which an absorption layer for absorbing liquid is arranged, with a nip roller and a regeneration roller, and arranging a section of the drying belt, which is supported by the nip roller, adjacent to the organic photo-conductor belt;

rotating the drying belt in a direction opposite to a rotational direction of the organic photo-conductor belt, whereby developer on the organic photo-conductor belt is absorbed by the absorption layer;

setting a cleaning roller, having a first heat source associated therewith, to contact the absorption layer having absorbed the developer, thereby to remove the toner included in the absorption layer and to vaporize the solvent included in the absorption layer using heat from said first heat source; and setting the regeneration roller, having a second heat source associated therewith, to contact the absorption layer from which the toner is removed by the cleaning roller, thereby to vaporize the solvent included in the absorption layer using heat from said second heat source.

16. The method according to claim 15, wherein a temperature of the cleaning roller and a temperature of the regeneration roller are so adjusted that a temperature of the section of the drying belt which is adjacent to the organic photo-conductor belt is retained to a temperature at which the toner does not melt.

17. The method according to claim 16, wherein a length of the section is so set that a time period the developer stays in the section is longer than a time period necessary for the absorption layer to absorb the solvent and shorter than a time period for the toner to melt.

18. The method according to claim 15, wherein outer circumference of the regeneration roller is so formed that an amount of the solvent absorbed by the absorption layer and vaporized is larger than an amount of the solvent absorbed by the absorption layer.

19. The method according to claim 15, wherein a relationship between a position X of within a cooled area of said drying belt, which is positioned between said regeneration roller of said drying belt and said nip roller, and a surface temperature Y at the position X is represented by $$Y=A\cdot X^2-B\cdot X+C$$

where A, B and C each denotes a constant.

20. The method according to claim 15, wherein a thickness of the absorption layer is set to a value so that the solvent and the toner not adhered to the organic photoconductor belt are easily absorbed thereby in the adjacent section, and that the absorption layer is easily dried by said regeneration roller and said cleaning roller.

21. The method according to claim 15, wherein a surface temperature of said cleaning roller is set to a temperature higher, by at least 10° C., than a temperature of a section of said drying belt which is immediately behind a section that is in contact with said cleaning roller.

22. The method according to claim 15, wherein a voltage of an opposite polarity which is opposite to a polarity of a voltage applied to the toner is applied to the cleaning roller.

* * * * *